US006000455A

United States Patent [19]

Semmler

[11] Patent Number: 6,000,455

[45] Date of Patent: Dec. 14, 1999

[54] HAND-HELD IMPLEMENT FOR TRANSFERRING A FILM OF E. G. ADHESIVE OR COATING OR COLORED MATERIAL FROM A BACKING STRIP WOUND ON A SUPPLY REEL TO A SUBSTRATE

[76] Inventor: Georg Semmler, Hasengartenstrasse 36A, D-65189 Wiesbaden, Germany

[21] Appl. No.: 08/919,811

[22] Filed: Aug. 29, 1997

[30] Foreign Application Priority Data

Sep. 2, 1996 [DE] Germany ..... 196 35 586

[51] Int. Cl.[6] ..... B32B 31/00

[52] U.S. Cl. ..... 156/540; 156/577; 156/579

[58] Field of Search ..... 156/574, 577, 156/579, 523, 540

[56] References Cited

U.S. PATENT DOCUMENTS

| | | | |
|---|---|---|---|
| 4,718,971 | 1/1988 | Summers | 156/577 X |
| 5,346,580 | 9/1994 | Elges et al. | 156/579 X |
| 5,480,510 | 1/1996 | Manusch et al. | 156/577 |
| 5,512,128 | 4/1996 | Manusch et al. | 156/579 X |
| 5,556,469 | 9/1996 | Koyama et al. | 156/577 X |
| 5,679,156 | 10/1997 | Matsumaru | 156/577 X |
| 5,759,341 | 6/1998 | Kobayashi | 156/577 X |
| 5,772,840 | 6/1998 | Morinaga | 156/577 X |
| 5,792,263 | 8/1998 | Koyama et al. | 156/577 X |
| 5,795,085 | 8/1998 | Yoo | 156/577 X |

FOREIGN PATENT DOCUMENTS

| | | |
|---|---|---|
| 8-059057 | 5/1996 | Japan . |
| 8-175738 | 9/1996 | Japan . |

*Primary Examiner*—Mark A. Osele
*Attorney, Agent, or Firm*—Kilgannon & Steidl

[57] ABSTRACT

The present invention relates to a hand-held implement for transferring a film of, e.g., adhesive or coating or colored material from a supporting strip wound on a supply reel onto a substrate, said implement comprising a housing, a pressure-exerting part projecting from the housing and with a pressure tip guiding and deflecting a supporting strip section, and two mounting and/or carrying devices arranged in the interior of the housing for the supply reel and a take-up reel for the supporting strip taken off from the supply reel and guided and deflected round the pressure-exerting part, the housing being open for the purposes of replacing a cassette carrying the supply reel and the take-up real, and a positioning device being provided for positioning the cassette in the housing.

8 Claims, 3 Drawing Sheets

HAND-HELD IMPLEMENT FOR TRANSFERRING A FILM OF E. G. ADHESIVE OR COATING OR COLORED MATERIAL FROM A BACKING STRIP WOUND ON A SUPPLY REEL TO A SUBSTRATE

BACKGROUND OF THE INVENTION

The present invention relates to a hand-held implement for transferring a film of, e.g., adhesive or coating or colored material from a supporting strip wound on a supply reel onto a substrate, said implement comprising a housing, a pressure-exerting part projecting from the housing and with a pressure tip guiding and deflecting a supporting strip section, and two mounting and/or carrying devices arranged in the interior of the housing for the supply reel and a take-up reel for the supporting strip taken off from the supply reel and guided and deflected round the pressure-exerting part, the housing being open for the purposes of replacing a cassette carrying the supply reel and the take-up reel, and a positioning device being provided for positioning the cassette in the housing.

A hand-held implement of this type is described in DE 36 44 946 C2. In this known hand-held implement the pressure-exerting part and the strip guidance device are arranged on the cassette. Also, a special backing device is provided between the cassette and the housing in the vicinity of the pressure-exerting part in order to support the cassette in its installed position in the housing. In this known arrangement the cassette is inserted into the housing from the front. However, this complicates the construction and assembly of the device, resulting in considerable manufacturing costs. It is also wasteful in materials since both the cassette and the pressure-exerting part represent "lost" parts that have to be disposed of when the cassette is replaced.

Apart from this, in this known arrangement a drive mechanism for driving the reel is arranged in the housing as a drive mechanism separate from the cassette. This also involves a complicated design and construction since a rotating shaft drive has to be arranged between the drive mechanism and the reels.

The object of the invention is to provide a hand-held implement of the type described in the introduction that is less complicated in design and construction.

This object is achieved by the features of claim 1.

SUMMARY OF INVENTION

In the arrangement according to the invention the pressure-exerting part is not mounted on the cassette but on the housing. Also, with a laterally open housing the cassette can be inserted from the side. This provides for a simple, inexpensive and compact design and construction, while at the same time ensuring ease of handling and use. The pressure-exerting part is accordingly a structural part of the housing which remains on the latter when the cassette is replaced and, therefore, does not have to be exchanged and is moreover not a "lost" part, as is the case in the known arrangement. Moreover the pressure-exerting part is securely held on the housing and can be subjected to a load, in which connection it should be borne in mind that when the film is transferred from the supporting or backing strip to the substrate the manual compression forces are exerted on the housing and are thus transmitted directly to the pressure-exerting part. On account of the direct arrangement on the housing it is also possible to achieve a better positioning of the pressure-exerting part, which is important having regard to unavoidable tolerances.

The invention is based on the fact that the backing strip section running from the supply reel over the pressure-exerting part to the take-up reel has a certain inherent stiffness on account of its connection at both ends to the reels, which stiffness can be displaced laterally onto the pressure-exerting part even if the said strip runs in the form of a loop or curved path. The cassette can be mounted on the housing part accommodating the latter in such a position with its end containing the backing strip section slightly tilted relative to the pressure-exerting part and/or somewhat displaced rearwards relative to the pressure-exerting part, so that the backing strip section is situated in front of the pressure-exerting part and can then be moved parallel to the housing part into the positioning device or bearing parts, or can be moved to the side remote from the pressure-exerting part and into the positioning device or bearing part. These measures can be executed simply and quickly and in a user-friendly manner.

The subclaims contain features that further improve the insertion of the cassette and the guidance of the backing strip, provide a housing that is easy and convenient to use, result in small parts that can be arranged without occupying much space, and ensure a simple and inexpensive manufacture.

BRIEF DESCRIPTION OF THE DRAWINGS

The invention and further advantages achievable by the latter will be described in more detail hereinafter on the basis of preferred embodiments and with the aid of the drawings, in which.

DETAILED DESCRIPTION OF THE INVENTION

Figure 1:
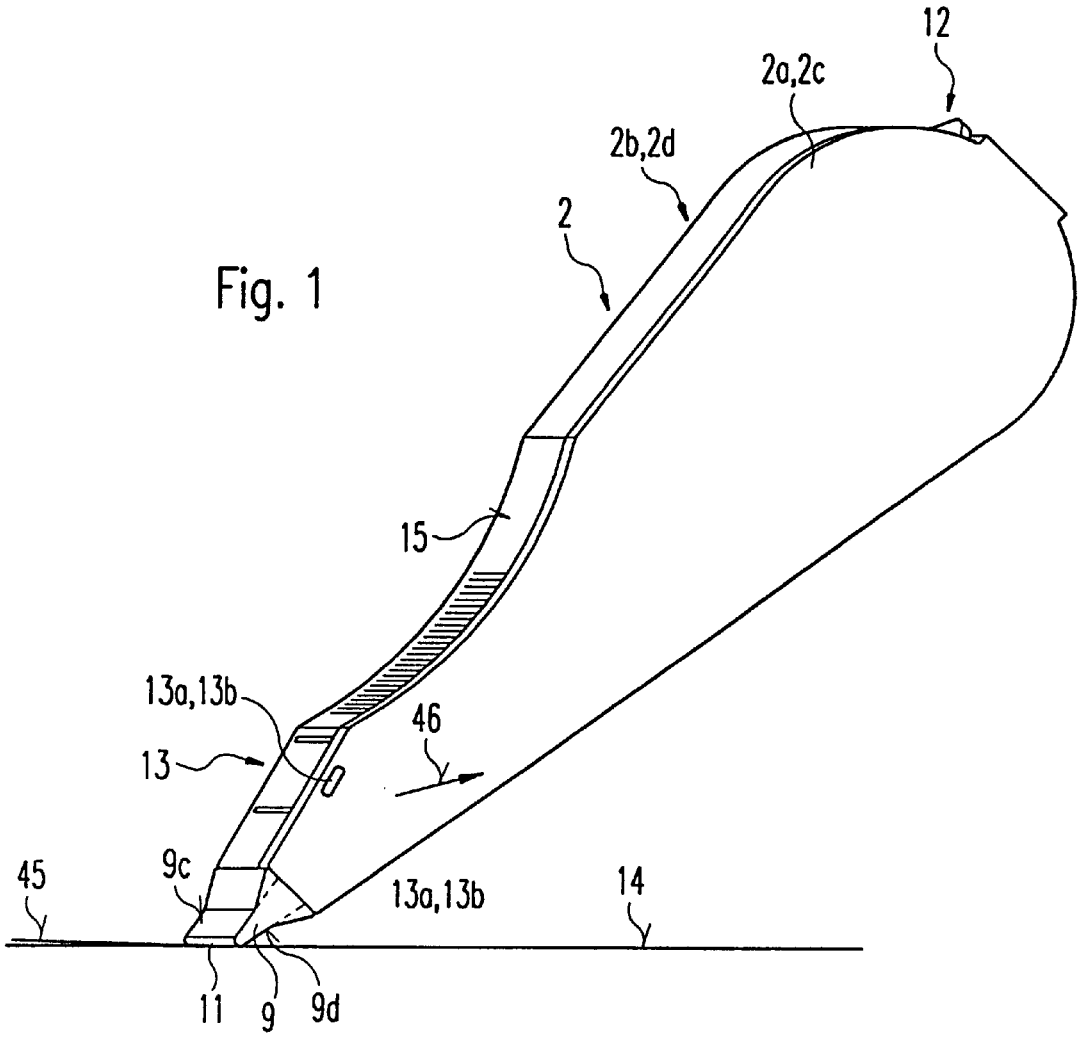
FIG. 1 is a perspective side view from above and from the front of a hand-held implement according to the invention with a two-part housing.

The principal parts of the hand-held implement 1 are the longitudinally divisible housing 2 with its housing parts 2*a*, 2*b*, a cassette 3 on which a supply reel 4 and a take-up reel 5 for a supporting or backing strip 6 are mounted and/or guided on bearing devices and on a strip guidance device, a positioning device 7 with positively engaging positioning device parts 7*a*1, 7*a*2 on the associated housing part 2*a* and positioning device parts 7*b*1, 7*b*2 on the cassette 3, a guide device 8 for introducing the cassette 3 between an insertion position and an end position with positively engaging guide device parts 8*a*1, 8*a*2 on the associated housing part 2*a*, and guide device parts 8*b*1, 8*b*2 on the cassette 3, and a pressure-exerting part 9 that is mounted on the housing 2 in a position projecting with a pressure vertex or tip 11 from the said housing 2.

The housing 2 is of flat construction and accordingly has oppositely facing broad side walls 2*c*, 2*d* and a narrow circumferential wall 2*e*. The housing parts 2*a*, 2*b* are joined to one another in the end region opposite the pressure-exerting part 5 by a hinge 12 and can thus be separated and laid open from each other. In the opened-out position according to FIG. 2, the housing part 2*a* forms a flat housing underpart and the housing part 2*b* forms a cap-shaped cover with the circumferential wall 2*e*. In the end region opposite the hinge 12, i.e, in the vicinity of the pressure-exerting part 9, a closure device, preferably a locking device 13, is arranged on the housing parts 2*a*, 2*b*. A small circumferential wall edge 2*f* is provided on the flat housing part 2*a*, the circumferential wall 2*e* and the circumferential wall edge 2*f* positively engaging with one another in the closed state of the housing 2 via an edge recess and an edge ridge engaging therein.

The tip 11 of the pressure-exerting part 2 extends straight and at right angles to the broad side walls 2*c*, 2*d* of the housing 2. In the use position according to FIG. 1 the housing 2 is arranged with the edge uppermost and in such a position that the pressure-exerting part 9 projects laterally and downwardly, so that its tip 11 can be pressed at an angle downwardly onto a substrate 14, for example, a sheet of paper.

In the present embodiment, the housing 2 seen sideways to its broad side walls 2*c*, 2*d* has the shape of a wedge with the pressureexerting part 9 situated at its tip end. The wedge angle w is about 20° to 40°, in particular about 30°. The end of the housing 2 remote from the pressure-exerting part 9 may be square or round, and in particular semi-circular. A preferably concavely rounded recess 15 is provided in the front end region of the housing 2 on its narrow top side. The size of the housing 2 is such that in the edgeways position it fits easily and conveniently in the hand of a person using the implement. A downwardly directed pressure on the housing 2 which is transmitted to the pressure-exerting part 9 can thus easily be exerted by a finger, especially the index finger, engaging the front region of the recess 15.

The cassette 3 has a flat base wall 16 with which it can abut the inside of the side wall 2*c* of the housing part 2*a*. For each reel 4, 5 a hollow cylindrical bearing bush 17, 18 on which the said reels 4,5 are rotatably mounted extends in the region of the relevant bearing point, from the inside of the base wall 16. The spacing of the rotational shafts or axes 4*a*, 5*a* of the reels 4, 5 is sufficiently large that at least a pair of the reel walls 19, 21 overlap one another.

A drive gear mechanism 22 acts between the reels 4, 5, the transition ratio of the mechanism being sufficiently large that the winding speed of the take-up reel side 5 is always, i.e., even in the case of a small take-up diameter, the same as or larger than the winding speed even of the full supply reel 4. In this connection a sufficient slippage is provided in the drive mechanism 22 so that, with a preset tensioning in the backing strip 6, the drive mechanism slips through. The backing strip 6 is, thus, always under tension without, however, breaking. In the present embodiment, the drive mechanism 22 is arranged directly between the reels 4, 5. The mechanism is formed by a toothed-gear drive in the region of two overlapping reel walls 19, 21. In the present embodiment, a ring gear 23 is situated on the circumference of one, in FIG. 2 the upper reel wall 19, of the larger supply reel 4, while the mating ring gear 24 is provided, preferably in an inclined arrangement, on the corresponding outer side of the reel wall 21 of the take-up reel 5. On account of the inclined arrangement, the reel wall 19 together with the ring gear 23 can deflect sideways if the prescribed tensile force is exceeded, thereby forming the slippage device.

The base wall 16 terminates at a distance a in front of the pressure-exerting part 9. Two vertical forked walls 25 project forwardly from the front end of the base wall 16, which forked walls can form at their rear ends by means of a rounded connecting wall, a U-shaped strip holding part or strip guidance part 27. Two further strip guidance parts are formed in the lower edge region of the base wall 16 by pins or studs projecting from the said base wall 16, the rear strip guidance pin 28 being spaced a small distance from the supply reel 4 and the front strip guidance pin 29 being spaced a small distance of about 1 mm from the lower and rear region of the strip guidance part 27.

The pressure-exerting part 9 has a wedge-shaped pressure-exerting head 9*a* terminating in the pressure tip 11 and a shank 9*b* extending backwardly from the head 9*a*, by means of which it is secured, preferably by means of a plug-in socket 31, on one housing part or on both housing parts 2*a*, 2*b*. In the present embodiment, the shank has a transversely aligned profiling with a rear head enlargement 32, and is inserted transversely with a small degree of play or in a clamping manner, in a correspondingly shaped plug-in bush 33 on the inside of the housing part 2*a*, and is positively held in the longitudinal direction on account of the aforementioned head enlargement. The plug-in bush 33 comprises thin, U-shaped bush walls that are open towards the front. Preferably the height of the plug-in bush 33 is less than the width b of the shank extending from one inside to the other inside of the side walls 2*c*, 2*d*, a plug-in bush 33*a* into which the shank 9*b* likewise engages in a positive manner also being arranged on the side wall 2*d* of the other housing part 2*b*. In this way the shank 9*b* is held in position on both housing parts 2*a*, 2*b*.

The pressure-exerting part 9 and its shank 9*b* project through the circumferential wall 2*d* of the housing part 2*b* in a hole located at the tip thereof, the size of the hole being such that a gap 34 for the exit and entry of the backing strip 6 is formed in each case on both sides of the lower and upper guide surface 9*c*, 9*d* formed by the wedge-shaped surfaces.

Figure 2:
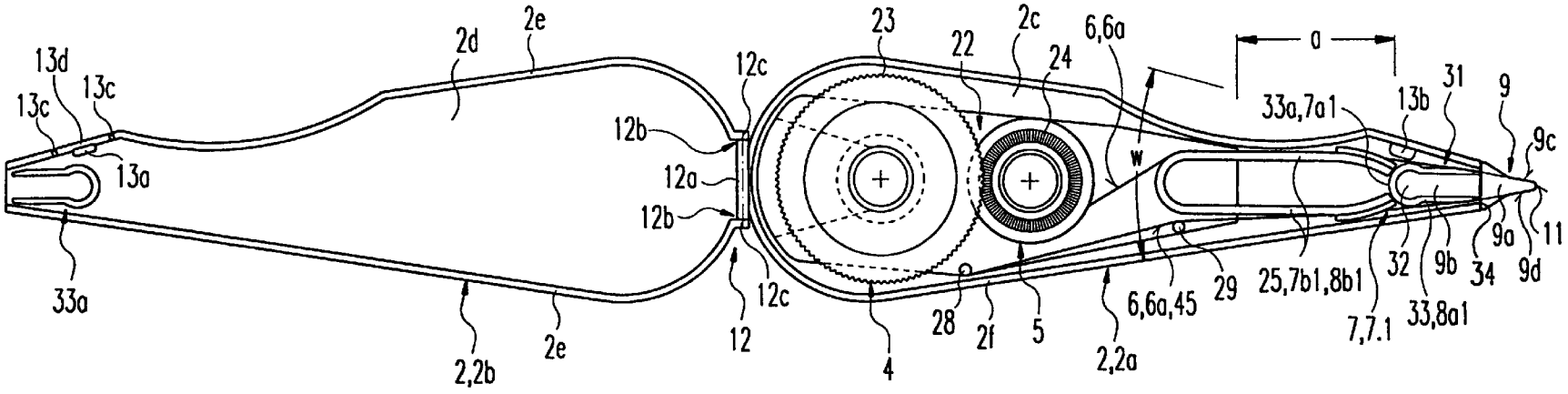
FIG. 2 is a plan view of the housing in the opened-out state.
Figure 3:
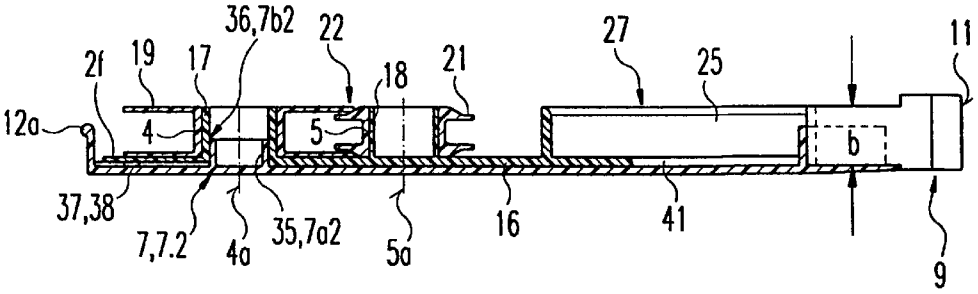
FIG. 3 is a partial sectional side view of the housing part containing a cassette.
Figure 4:
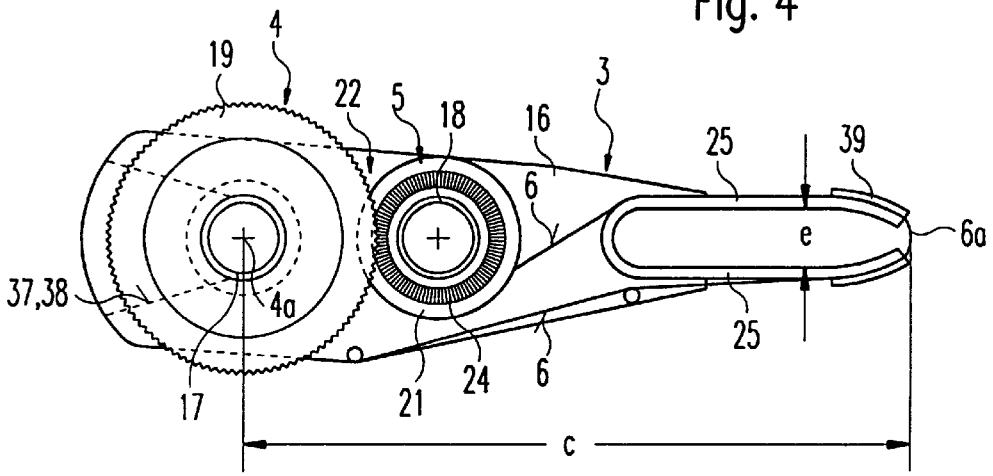
FIG. 4 is a plan view of the cassette.

The forked walls 25, which preferably converge forwardly in an inclined or rounded manner at their free ends, surround the plug-in bush 33 in the end position of the cassette 3 illustrated in FIG. 2 and more precisely preferably in its rear region which tapers to form a wedge or a round section, as can clearly be seen in FIG. 2. A first positioning device part 7.1 is thereby formed by the ends of the forked walls 25 forming the positioning elements 7*b*1 and by the C-shaped round part 33*a* of the plug-in bush 33 forming a positioning element 7*a*1. A second part 7.2 of the positioning device 7 is formed by a preferably hollow cylindrical plug-in peg 35 that projects on the inside of the side wall 2*c* of the housing part 2*a* and engages in a somewhat locking manner in a plug-in hole 36 in the base wall 16 and optionally also in the existing bearing bush 17. The plug-in peg 35 and the plug-in hole 36 form the second part 7.2 of the positioning device 7 with a positioning device element 7*a*2 on the housing side and a positioning device element 7*b*2 on the cassette side. In the end position of the cassette 3 the base wall 16 is on all sides spaced from the circumferential wall ridge 2*f* of the housing part 2*a*. It is also possible to form the positioning device 7 so that the base wall 16 fits in a positively engaging manner between the circumferential wall ridge 2*f*.

The guide device 8 similarly has a rear and a front guide device part 8.1 and 8.2, respectively. The rear guide device part 8.2 is formed as a guide device element 8*b*2 in the base wall 16 by a flat recess 37 on the underside, which recess is bounded by rearwardly diverging, flank-shaped recess walls 38 that extend rearwardly, freely and tangentially from the plug-in hole 36 and that can receive the plug-in peg 35, as guide device element 8*a*2.

The front part of the guide device 8.1 is formed as a guide device element 8*a*1 by the forked walls 25 that can be deflected outwardly in an elastic manner and that cooperate as a guide device element 8b1 with the side regions of the round part 33*a* of the plug-in bush 33, which will become clear from the installation position of the cassette 3 described hereinafter.

Within the scope of the invention it is possible to pre-package the cassette 3 together with the reels 4, 5 and the backing strip 6 as a ready-to-use unit, so that the backing strip section 6*a* extending from the supply reel 4 to the take-up reel 6 forms a forwardly free-standing loop that is larger than the pressure-exerting part 9 and that, in order to insert the cassette 3, is firstly mounted on the pressure-exerting part 9 in a position of the cassette 3 to be held in the hand that is parallel to or tipped forwardly against the pressure-exerting part 9, the cassette 3 being pressed as a whole against the housing part 2 and introduced into the positioning device 7. In this connection it is also possible to thread the strip loop in a forwardly displaced position of the cassette and then displace the cassette in the guide device 8 rearwardly to its end position. It is moreover possible to make the loop shorter so that the backing strip 6 is drawn off from the supply reel 4 during the rearwards displacement.

Figure 6:
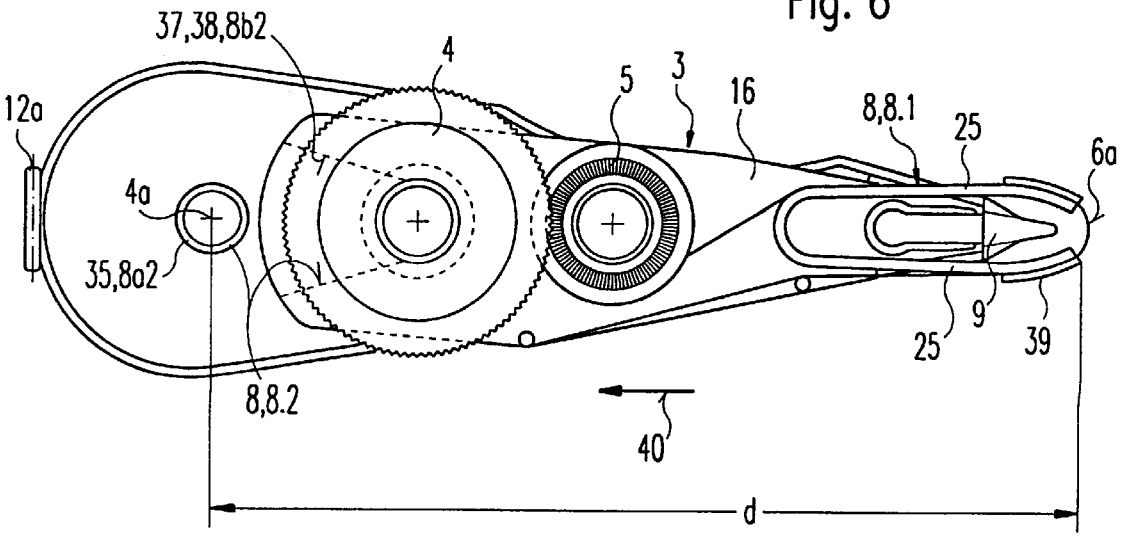
FIG. 6 is a plan view of an intermediate installation position of the cassette in the housing part.

The latter is also the case with the present preferred embodiment, in which the loop-shaped backing strip section 6*a* is laid, prefabricated, around the free ends of the forked arm 25 as a holding device, whose distance c from the rotational axis 4*a* of the reel 4 is less than the distance d of the tip 11 from the rotational axis. By means of guide ridges 39 arranged and spaced apart on the free edges of the forked arms 25 on their lateral edges, the backing strip 6 can in each case be securely guided in the form of a groove-shaped track between a pair of guide ridges. In order to insert the cassette 3 in the forwardly displaced insertion position the forked walls 25 are mounted on the pressure-exerting part 9 in a position of the cassette 3 parallel or inclined relative to the pressure-exerting part 9, so that the loop-shaped backing strip section 6*a* runs out in front of the pressure tip 11 (FIG. 6), the forked walls—so long as they are at a lesser distance 3 from one another than the associated cross-section dimension of the pressure-exerting part—being able to independently and elastically unbend. The front part 8.1 of the guide device 8 is thereby already in the guidance position. Following this the cassette 3 simply needs to be tilted if necessary against the housing part 2*a*, whereupon the plug-in peg 35 enters the region of the recess 37 and thereby also the rear guidance device part 8 is caused to exercise a guidance function and/or the cassette 3 is by a rearwards displacement (arrow 38) displaced to its end position, in which the rear part 7.2 of the position device 7 functions so that the plug-in peg 35 engages in the plug-in hole 36. The necessary amount of backing strip 6 is reeled off by the rearwards displacement. The invention thus relates to a special installation procedure for mounting the cassette. Following this all that needs to be done is to close together the parts of the housing 2.

Figure 5:
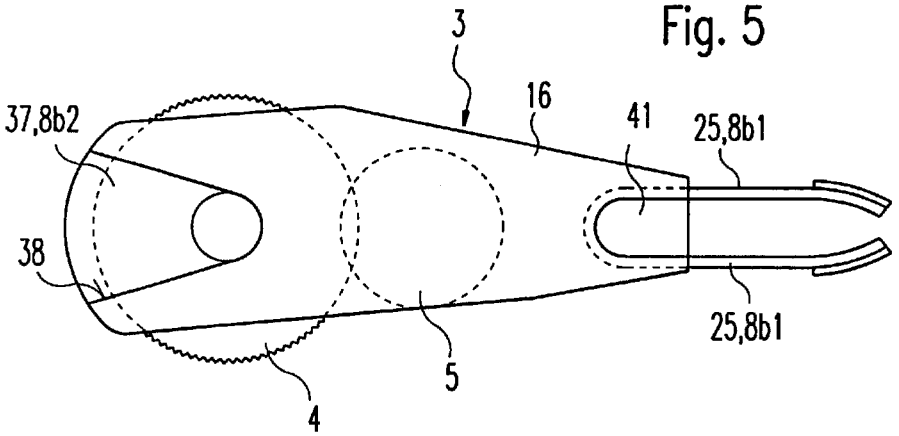
FIG. 5 is a view of the cassette from below.

The guidance function of the front part 8.1 of the guidance device 8 can be improved by arranging, in the front region of the base wall 16, a recess 41 (FIG. 5) open at the front in the underside of the base wall 16 or in a continuous manner. This recess 41 enables the cassette 3 to abut early against the housing part 2*a* so that the rear part of the shank 9*b* and the profiled bush 33 can engage in the recess 41.

The hinge 12 is preferably designed so that it can clip in. For this purpose a hinge axis 12*a* preferably arranged on the housing part 2*a* may be provided, which snap fits into two hinge recesses 12*b* arranged on the housing part 2*b* on the mutually facing sides of hinge walls 12*c* extending transversely to the side walls 2*c*.

The locking device 13 is preferably arranged on the upper side in the front end region of the housing 2. In the present embodiment the locking device is formed by a catch 13*a* that engages in a locking recess 13*b* arranged in the upper edge region of the side wall 2*c* of the housing part 2*a* and resiliently engages a locking edge arranged in the said recess. The catch 13*a* projects from the side edge of a spring arm 13*d* having two transversely running sections or slits 13*c* cut out from the circumferential wall 2*e*, which arm can be bent by finger pressure in order to release the locking device 13. The locking recess 13*b* is dimensioned for an appropriately large spring path.

The individual parts of the aforedescribed hand-held implement 1 are made of plastics material, and are more specifically injection molded parts. It is possible to manufacture the handheld implement 1 from just seven parts, namely two housing parts 2*a*, 2*b*, the pressure-exerting part 9, the cassette 3 together with the base wall 16, the forked arms 25 and the strip guidance parts, the supply reel 4, the take-up reel 5, and the backing strip 6.

In order to transfer a film 45 coated on the underside of the backing strip 6 onto the substrate 14, the implement 1 is held in the hand and pressed onto the substrate 14 in a position according to FIG. 1, in which only the pressure-exerting part 9 together with its pressure tip 11 presses the backing strip 6 against the substrate 14. When the hand-held implement 1 is drawn backwards (arrow 39) on the substrate 15, the backing strip is wound off the supply reel 4 and simultaneously wound onto the take-up reel 5, the film 45 on the pressure tip 11 being removed from the backing strip 6 and remaining as a strip-like coating or layer on the substrate 14.

I claim:

1. A hand-held device (1) for transferring a film (45) of, for example, adhesive or coating or colored material from a backing strip (6) onto a substrate (14), comprising a housing (2), a pressure exerting part (9) mounted on the housing and projecting therefrom and having a pressure tip (11), a cassette (3) which can be positioned in the housing (2) by means of a positioning device (7) and two bearing means arranged in the cassette interior for bearing a supply reel (4) and a take-up reel (5), from which a backing strip (6) in the form of a loop (6*a*) extends around the pressure exerting part (9) and is deflected about the same, wherein the housing (2) can be opened laterally for replacing the cassette (3), wherein a holding device for the loop (6*a*) is arranged on the end section of the cassette (3) facing the pressure exerting part (9), which holds the loop (6A) in such a position that the loop (6*a*) can engage the pressure exerting part (9) by a lateral engagement movement of the cassette (3) towards the housing part (2*a*) characterized in that the cassette (3) comprises a base wall (16) on which the bearing means for bearing the supply reel (4) and the take up reel (5) are arranged, the housing part (2) comprises a guide part (8) for the cassette (3) in which the cassette (3) can be inserted in a forwardly displaced insertion position during lateral engagement towards the housing (2) and can then be rearwardly displaced in the guide (8) into an end position.

2. A hand-held device (1) according to claim 1, characterized in that the holding device is formed by two forked projecting arms (25) arranged between the backing strip sections of the loop (6*a*).

3. A hand-held device (1) for transferring a film (45) of, for example, adhesive or coating or colored material from a backing strip (6) onto a substrate (14), comprising a housing (2), a pressure exerting part (9) mounted on the housing and projecting therefrom and having a pressure tip (11), a cassette (3) which can be positioned in the housing (2) by means of a positioning device (7) and two bearing means arranged in the cassette interior for bearing a supply reel (4) and a take up reel (5), from which a backing strip (6) in the form of a loop (6*a*) extends around the pressure exerting part (9) and is deflected around the same, wherein the housing (2) can be opened laterally for replacing the cassette (3) wherein a holding device for the loop (6*a*) is arranged on the end section of the cassette (3) facing the pressure exerting part (9), which holds the loop (6) in such a position that the loop (6*a*) can engage the pressure exerting part (9) by a lateral engagement movement of the cassette (3) towards the housing (2*a*), characterized in that the holding device is formed by two forked projecting arms (25) arranged between the backing strip sections of the loop (6*a*).

4. A hand-held device according to claim 2 or 3, characterized in that the forked arms (25) converge diagonally or rounded forwards at their free ends.

5. A hand-held device according to any one of claims 2 or 3, characterized in that the loop (6*a*) is laid around the free ends of the forked arms (25).

6. A hand-held device according to claims 2 or 3, characterized in that the section of the loop (6*a*) extending between the free ends of the forked arms (25) is located in the insertion position forward of the pressure exerting part (9).

7. A hand-held implement as claimed in claim 3, wherein the distance (e) of the arms (25) from one another and their length are larger than the dimensions of the pressure-exerting part (9).

8. A hand-held implement as claimed in claim 3, wherein the length of the arms (25) is greater than the relevant length of the pressure-exerting part (9), that the distance (e) of the arms (25) from one another is less than the pressure-exerting part (9), and that the arms (25) can elastically bend sideways.

* * * * *

UNITED STATES PATENT AND TRADEMARK OFFICE

CERTIFICATE OF CORRECTION

PATENT NO. : 6,000,455

DATED : December 14, 1999

INVENTOR(S) : Georg Semmler

It is certified that error appears in the above-indentified patent and that said Letters Patent is hereby corrected as shown below:

Title Page, insert:

--[73] Assignee: Tipp-Ex GmbH & Co. KG, Liederbach, Fed. Rep. of Germany--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*